US005715637A

United States Patent [19]

Hesterman et al.

[11] Patent Number: 5,715,637

[45] Date of Patent: Feb. 10, 1998

[54] PREFABRICATED COMPOSITE BUILDING PANEL WITH IMPROVED FIRE RETARDANCY

[75] Inventors: Larry C. Hesterman; Rolf C. Holzkaemper, both of Regina, Canada

[73] Assignee: Pan-Brick, Inc., Saskatchewan, Canada

[21] Appl. No.: 429,553

[22] Filed: Apr. 27, 1995

[51] Int. Cl.[6] ..... E04C 2/288; E04F 13/14

[52] U.S. Cl. ..... 52/315; 52/309.8; 52/387; 52/389

[58] Field of Search ..... 52/314, 315, 309.7, 52/309.11, 600, 316, 592.1, 309.8, 309.9, 309.14, 386, 387, 389; 106/772–788; 428/703

[56] References Cited

U.S. PATENT DOCUMENTS

| | | | |
|---|---|---|---|
| 3,646,715 | 3/1972 | Pope | 52/309 |
| 3,715,417 | 2/1973 | Pope . | |
| 3,740,909 | 6/1973 | Stinnes . | |
| 4,196,008 | 4/1980 | Kennedy-Skipton | 106/115 |
| 4,299,069 | 11/1981 | Neumann | 52/309.4 |
| 4,407,104 | 10/1983 | Francis | 52/314 X |
| 4,741,137 | 5/1988 | Barratt | 52/314 |
| 4,947,600 | 8/1990 | Porter | 52/315 X |
| 5,152,937 | 10/1992 | Tetu . | |
| 5,280,689 | 1/1994 | Mill | 52/314 X |
| 5,311,714 | 5/1994 | Passeno | 52/314 |
| 5,454,866 | 10/1995 | Gilbert et al. | 106/695 |

*Primary Examiner*—Michael Safavi

*Attorney, Agent, or Firm*—Sterne, Kessler, Goldstein & Fox P.L.L.C.

[57] ABSTRACT

A prefabricated composite panel of the type comprising a supporting plywood board, a foamed sheet of polyurethane and a covering layer on the front face of the polyurethane comprising a plurality of brick slices with an aggregate in the spaces between the brick slices which is bonded into the front face of the foam is improved in its fire retardancy by providing a plurality of vertical support metal strips on the inside face of the brick slices at spaced positions across the width of the panel. Each metal strip includes a hanger element at the top which engages over a portion of the foam and a plurality of punched tabs each of which engages under a respective one of the brick slices. The support strips prevent sagging of the brick slices when heat is applied to the front face of the panel since that sagging can allow the heat to penetrate cracks in the covering aggregate. The fire retardancy is further improved by the addition of gypsum to the aggregate which reduces the temperature by releasing water molecules. A yet further improvement provides a reinforcing element in the form of expanded metal embedded in the foam sheet behind those ones of the brick slices which project outwardly at the sides beyond the end of the board.

26 Claims, 6 Drawing Sheets

PREFABRICATED COMPOSITE BUILDING PANEL WITH IMPROVED FIRE RETARDANCY

BACKGROUND OF THE INVENTION

This invention relates to a prefabricated composite building panel of the type comprising a rigid sheet of foamed cellular polymeric material, such as polyurethane, on an outer face of which is attached a plurality of facing elements, such as brick slices, which are partly embedded in and attached to the outer face by the foaming action of the polymeric material. The facing elements are arranged in a pattern with spaces between the facing elements with those spaces being filled by a covering layer on the outer face of the sheet which is preferably formed of an aggregate intimately bonded into or integrated with the outer face of the polymeric sheet by the foaming action of the polymeric material.

Building panels of this type are shown in U.S. Pat. Nos. 3,646,715 and 3,715,417 (Pope) assigned to Dupont of Canada and U.S. Pat. No. 3,740,909 (Stinnes) to the same Assignee.

All of these patents relate to a system of manufacturing prefabricated composite panels which has achieved some commercial success. One point which has to some extent limited commercial success is that of a restriction in the fire retardancy qualities of the product. The brick facing elements are of course resistant to combustion. The aggregate which is embedded into the outer layer of the polyurethane foam sheet is also resistant to combustion. However the polyurethane foam itself is combustible and hence there is some possibility of the panel as a whole reaching a state of combustion so that the panel breaks down allowing direct access by the flame to the foam which can then burn freely eventually allowing access to the wall structure behind the panel.

Combustion tests have been observed and it has been found that once the aggregate layer filling the spaces between the facing elements has been breached by the combustion, rapid combustion of the polyurethane foam behind the facing elements and the aggregate soon occurs thus causing breakdown of the panel. Thus the panel is resistant to combustion for an initial period of time but once the layer is breached then the breakdown of the panel soon follows.

In one type of test, the panel has been unable to meet the standards required in that the initial period of time before the panel begins to break down almost reaches the required standard period of time but unfortunately cannot achieve that standard before the panel begins to break down.

It is one object of the present invention, therefore, to provide an improved panel of the above type which provides an improved fire retardancy thus enabling the panel to reach or exceed the required standards.

A more recent patent related to such building panels is U.S. Pat. No. 5,152,937 (Tetu) which discloses a method for manufacturing right angle corner pieces. In this method it is necessary to tilt the facing elements and aggregate therebetween on one side of the corner to a position which is at or nearly at a vertical orientation so as to move the other side of the corner to a nearly horizontal orientation to be filled with the aggregate. It is necessary therefore to provide a technique for holding the aggregate in place on the vertical side before the foaming process is effected to bond the aggregate in place simultaneously on both sides.

SUMMARY OF THE INVENTION

According to one aspect of the invention there is provided a prefabricated composite building panel for attachment to a vertical wall of a building comprising a rigid sheet of cellular polymeric material having an outer face for facing outwardly of the wall and an inner face for facing inwardly of the wall, a plurality of rigid facing elements embedded to the outer face of the sheet so as to define an outermost surface of the panel, the facing elements being attached to the outer face in a pattern defining spaces between at least some of the facing elements and adjacent ones of the facing elements, a covering layer on the outer face of the sheet in the spaces and mechanical support means engaging the sheet and formed from a rigid material different from the cellular polymeric material and engaging a plurality of the facing elements to provide mechanical support of the facing elements to resist downward sagging of the facing elements on the sheet.

According to a second aspect of the invention there is provided a prefabricated composite building panel for attachment to a vertical wall of a building comprising a rigid sheet of cellular polymeric material having an outer face for facing outwardly of the wall and an inner face for facing inwardly of the wall, a plurality of rigid facing elements bonded to the outer face of the sheet so as to define an outer most surface of the panel, the facing elements being attached to the outer face in a pattern defining spaces between at least some of the facing elements and adjacent ones of the facing elements, and a covering layer on the outer face of the sheet in the spaces wherein the covering layer is formed from an aggregate monolithically foamed into the outer face, the aggregate including a weather resistant particulate material and gypsum.

It has been found surprisingly that the mechanical support of the facing elements prevents the sag of those elements which can otherwise occur on application of heat to the outside surface of the panel. It has been found that the sag which occurs during the heat application causes some of the spaces between the facing elements to increase thus forming cracks in the covering layer and exposing the underlying face of the polyurethane foam to direct application of the combustion. Provided the time period during which the polyurethane foam is fully covered by the covering layer on the facing elements can be increased, this significantly delays the onset of the rapid collapse of the structure of the panel and enables the panel to meet the standards required.

Yet further an improvement can be obtained by adding gypsum to the covering layer either as a layer underneath the aggregate or as an intimately mixed composite with the aggregate. The gypsum carries water molecules which, when heated, tend to give off the water as water vapor providing a significant cooling action on the product. This addition therefore of the gypsum assists in maintaining the covering layer in a cooled condition to yet further prevent or inhibit the penetration of the combustion through the covering layer to the underlying polyurethane foam.

According to a third aspect of the invention therefore there is provided a prefabricated composite building panel for attachment to a vertical wall of a building comprising a rigid sheet of cellular polymeric material having an outer face for facing outwardly of the wall and an inner face for facing inwardly of the wall, a plurality of rigid facing elements embedded in the outer face of the sheet so as to define an outermost surface of the panel, the facing elements being attached to the outer face in a pattern defining spaces between at least some of the facing elements and adjacent ones of the facing elements, a covering layer on the outer face of the sheet in the spaces, the facing elements comprising rectangular bodies arranged in a staggered pattern with spaces therebetween, the pattern being arranged such that at each end of the panel there are a plurality of the facing elements each of which has a portion thereof projecting from and exposed at the end of the sheet, each of said elements having a portion of the sheet behind the element, and reinforcement means formed from a material different from the cellular polymeric material and embedded within the sheet and extending into the portion of the sheet behind the element.

A yet further object of the invention relates to solving the problem of holding the aggregate in place during the tilting necessary when manufacturing corner pieces.

According to a fourth aspect of the invention therefore there is provided a prefabricated composite building panel for attachment to a vertical wall of a building comprising a rigid sheet of cellular polymeric material formed by a foaming process and having an outer face for facing outwardly of the wall and an inner face for facing inwardly of the wall, a plurality of rigid facing elements embedded in the outer face of the sheet during the foaming process so as to define an outermost surface of the panel, the facing elements being attached to the outer face in a pattern defining spaces between at least some of the facing elements and adjacent ones of the facing elements, a covering layer on the outer face of the sheet in the spaces the covering layer being formed from an aggregate monolithically integrated into the outer face during the foaming process, the aggregate having at an inner extent thereof a coating of a spray adhesive applied to the aggregate prior the foaming process and having sufficient adhesive effect to hold the aggregate in place when the aggregate and facing elements are tilted from an initial horizontal plane while not interfering with the monolithic integration of the outer face of the polymeric material with the aggregate during the foaming process.

Preferably the coating is applied so that it engages those particles of the aggregate which are exposed between the facing elements prior to the foaming process and the facing elements adjacent the aggregate to hold the aggregate in position between the facing elements while the facing elements and the aggregate are tilted.

Embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
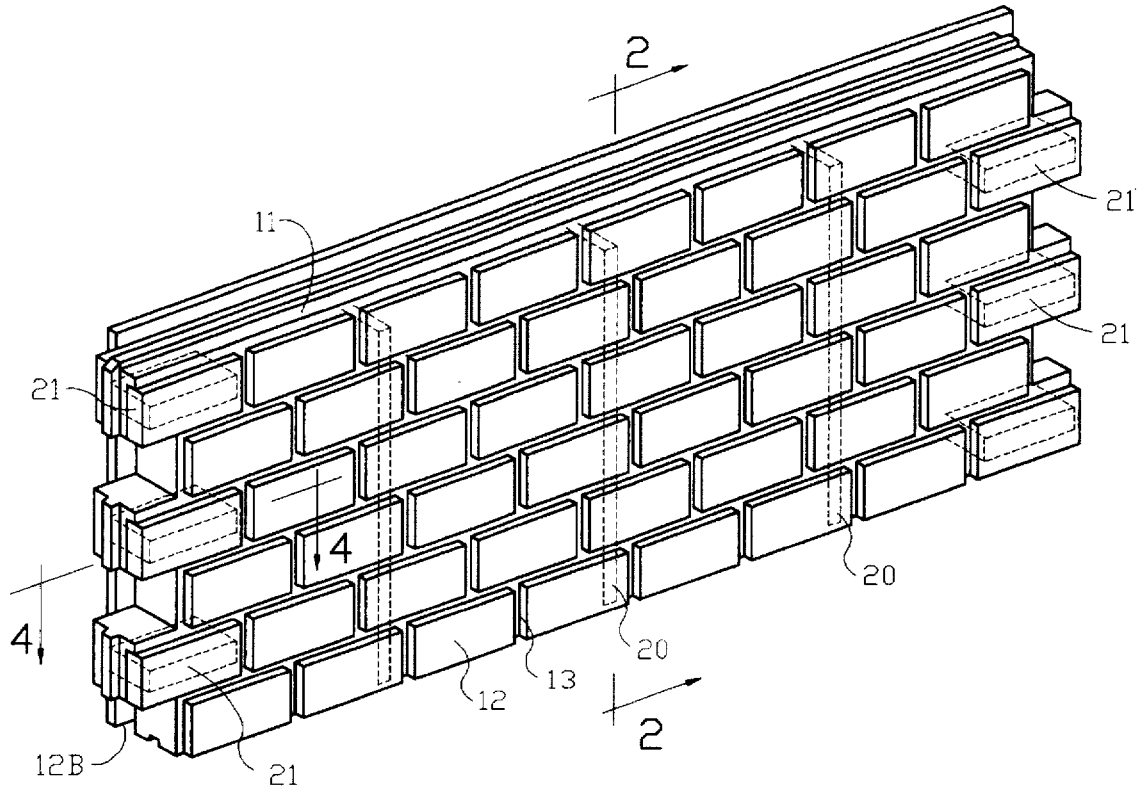
FIG. 1 is an isometric view of a panel according to the present invention.

The panel of the type shown in FIG. 1 is generally described in detail in the above mentioned patents and therefore the details of the materials involved, the method of manufacture and the techniques for interconnection of the panels are not described herein as they are well known from the product available on the marketplace and from the above patents.

In general the type of panel shown includes a rear support board 10 of plywood or the like, a main rigid sheet 11 of polyurethane foam or similar cellular polymeric material, a plurality of facing elements 12 and a covering layer 13. The board 10 is attached to a rear or inner surface 15 of the foamed sheet 11. The board is intended to be attached to an outer face of a wall thus facing inwardly of the wall with the wall standing vertically. The panel is intended for exterior cladding although it can of course be used in other situations.

The sheet 11 is rigid in the finished product but is formed by a foaming action in situ within a mold defined in part by the board 10 and the facing elements. The sheet 11 has a front face 16 which faces outwardly away from the wall to which the panel is attached. The front face 16 is fully covered either by the facing elements 12 or, in the spaces between the facing elements 12 by the covering layer 13.

The facing elements 12 each comprise a brick slice so that the facing elements are rectangular and are laid in a brick pattern so that there are rows of the facing elements with the rows being offset by half of the transverse dimension of the facing element to form the conventional brick pattern readily visible in FIG. 1.

The covering layer 13 is formed from an aggregate which is embedded in the front face of the rigid foam sheet. The bonding effect takes place during the foaming of the rigid sheet so that the materials are in effect monolithic with the aggregate embedded in and foamed with the foamed layer.

The above panel description relates to the conventional panel and the conventional panel is modified in accordance with the present invention by a number of improvements. Firstly there are provided a plurality of mechanical support members 20 embedded within the foam sheet and arranged for supporting the facing elements on the front face of the sheet. Secondly the foam sheet is reinforced by a plurality of reinforcing members 21. Thirdly the covering layer 13 is modified by the addition of gypsum indicated at 22 within the aggregate 23.

Figure 2:
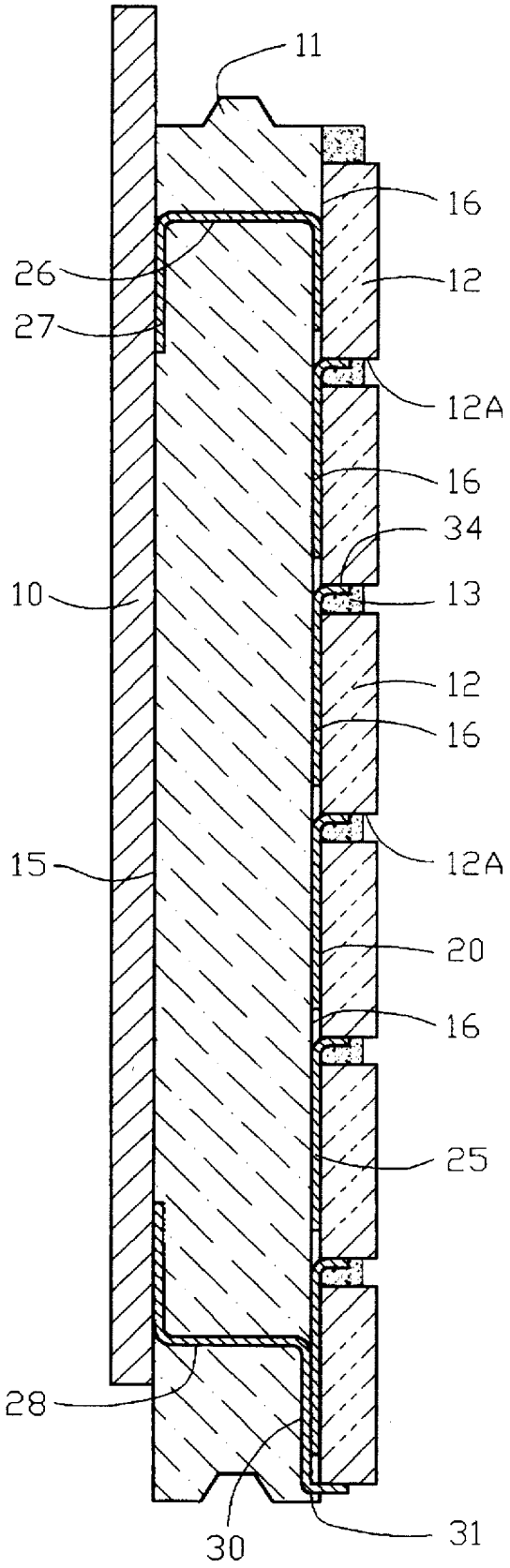
FIG. 2 is a cross sectional view along the lines 2—2 of FIG. 1.
Figure 3:
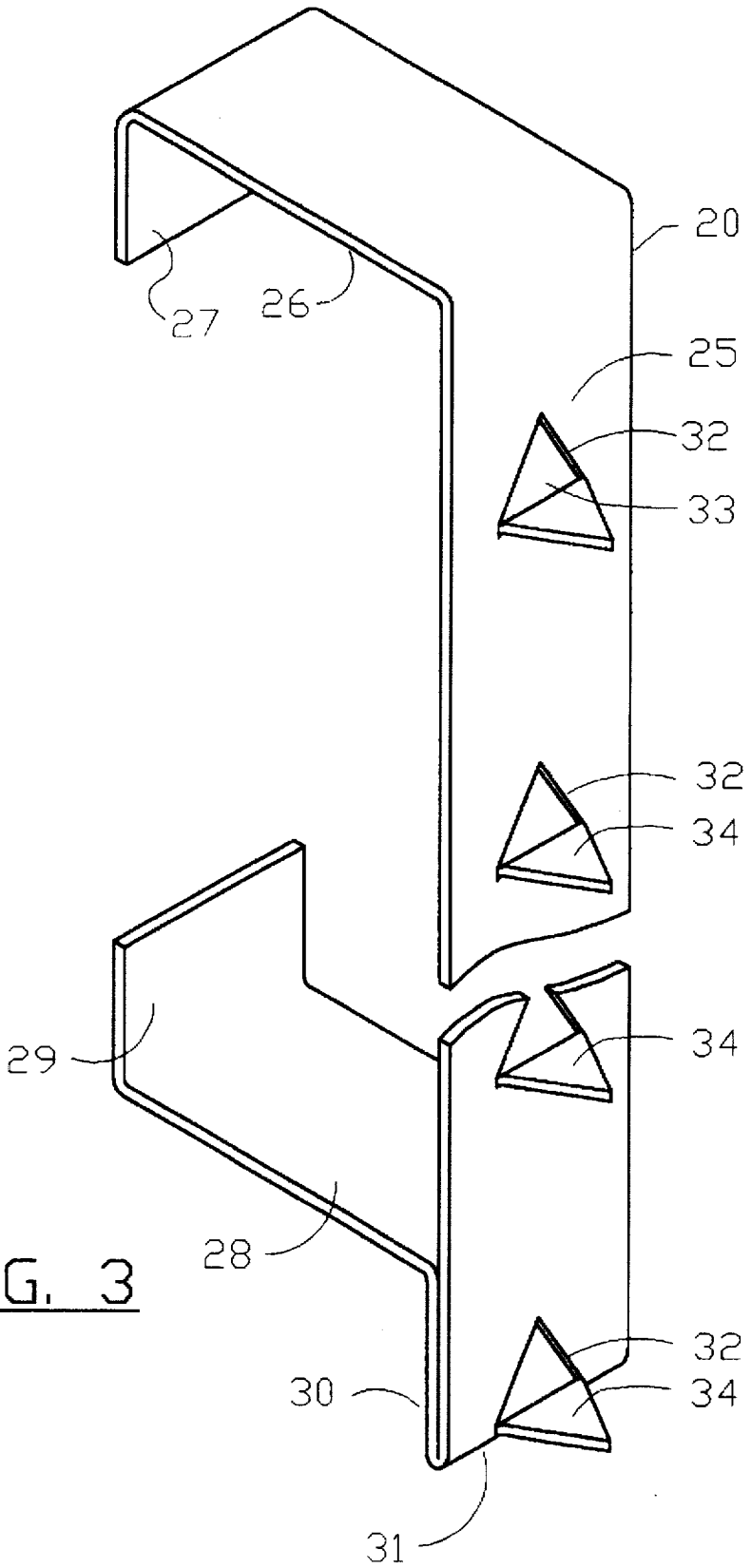
FIG. 3 is an isometric view on an enlarged scale of the mechanical support member of FIG. 1 and 2.

Turning therefore firstly to the mechanical support structure 20 as shown in cross section in FIG. 2 and in separate isometric view in FIG. 3, The mechanical support structure 20 comprises an elongate strip 25 which is arranged in vertical orientation in the finished panel at a position immediately rearward of the facing elements 12. The vertical strip 20 has an upper horizontal portion 26 which is turned rearwardly at right angles to the vertical strip 25 and a down turned rearward portion at a rear end of the horizontal portion 26. The strip further includes a lower horizontal portion 28 and an upturned rear portion 29 lying in a common plane with the rear portion 27. The second horizontal portion 28 is arranged at an upper end of a turned back portion 30. The turned back portion 30 is formed by folding the strip 25 at a lower edge 31 so as to lie directly rearwardly behind the strip 25 generally in contact therewith. This locates the lower horizontal portion 28 at a position spaced from the lower most edge 31 of the strip 25.

Along the strip 25 is a plurality of punched cut outs 32 each of which is formed by punching a hole 33 in the material of the strip and by turning the material of the hole outwardly to form a tab 34 extending horizontally outwardly from the front face of the strip that is at right angles to the strip.

The length of the upper and lower horizontal portions 26 and 28 from the strip 25 to the rear portion 27, 29 is equal to the thickness of the layer from the rear surface facing element to the front surface of the board. Thus as shown in FIG. 2 the mechanical support member is positioned within the panel so that it engages the rear face of the facing elements and the front face of the board and the foam of the sheet 11 is foamed around the mechanical support member to hold it in place.

The tabs 34 are arranged to be spaced along the length of the strip 25 so as to engage an undersurface 12A of each of the facing strips. Thus as shown in FIG. 2, there are six rows of facing elements and thus the strip 25 has six tabs 34 arranged at the requisite spacing to engage under the lower faces 12A of the facing elements.

The tabs 34 are shown to be triangular in shape and centered along a centre of the strip 25. However it will be appreciated that the tabs can be of any suitable shape and may indeed be located at one edge of the strip.

In the manufacture of the panel, as is well known from the previous patents, the facing elements are located within a mold and the board is supported by the mold at a spaced position from the rear of the facing elements. Foam is then injected into the space defined between the facing elements and the board to form the sheet 11. In a modified arrangement of the present invention, prior to placing the board in position to close the area to receive the foam, the mechanical support members 25 are located in place by placing the tabs 34 in the spaces between the spacing elements and by pushing the strip 25 along the rear face of the facing elements until the tabs are tight up against the lower surface 12A. When the board is closed into place, the board engages the rear portions 27 and 29 and thus holds the mechanical support members fixed in place while the foaming occurs. The mechanical support members are therefore preferably not attached to the board itself except by the bonding effect of the foaming action.

In the example shown there are three such mechanical support members located at horizontally spaced positions along the length of the panel. Each of these support members thus engages a plurality of the facing elements and provides a physical support over and beyond the support provided by the engagement with the foam sheet 11 to prevent the facing elements from sagging under their own weight. This mechanical support is particularly effective and required during fire retardancy since there is a tendency for the facing elements to sag when heated beyond a predetermined level at which time the front face of the foam sheet tends to lose its structural stability allowing some of the facing elements to gradually and slightly sag along the front face of the foamed sheet. Without the presence of the mechanical support members, when this sagging occurs, the sagging slightly increases the spacing between some of the spacing elements and this allows the coating layer 13 to crack allowing penetration of heat and flame to engage the foam sheet. With the mechanical support members in place, each of the facing elements which is spanned by the strip 25 is supported by its respective tab. It has been found that the provision of three of such support members provides sufficient support for all of the facing elements to prevent the above mentioned slight sagging to occur and thus prevents the cracking in the coating layer 13. The mechanical support member 25 is formed from metal or other suitable material which is resistant to heat damage and collapse.

For simple and inexpensive manufacture, the strip is preferably manufactured from sheet metal which can be readily bent and punched to form the structure shown in FIG. 3. The upper horizontal portion 26 acts as a hanger since it is supported over its full width by the foam sheet at a position embedded within the foam sheet so that it provides mechanical support for the front strip 25. The horizontal portion is embedded within the foamed sheet so as to provide increased strength and to prevent the metal being exposed at the surface of the sheet. As the horizontal portion engages the full width of the foam sheet it is not prone to sagging when the foam loses its strength on heating in a fire, as can occur with the facing elements simply on the front face of the foam sheet.

Figure 4:
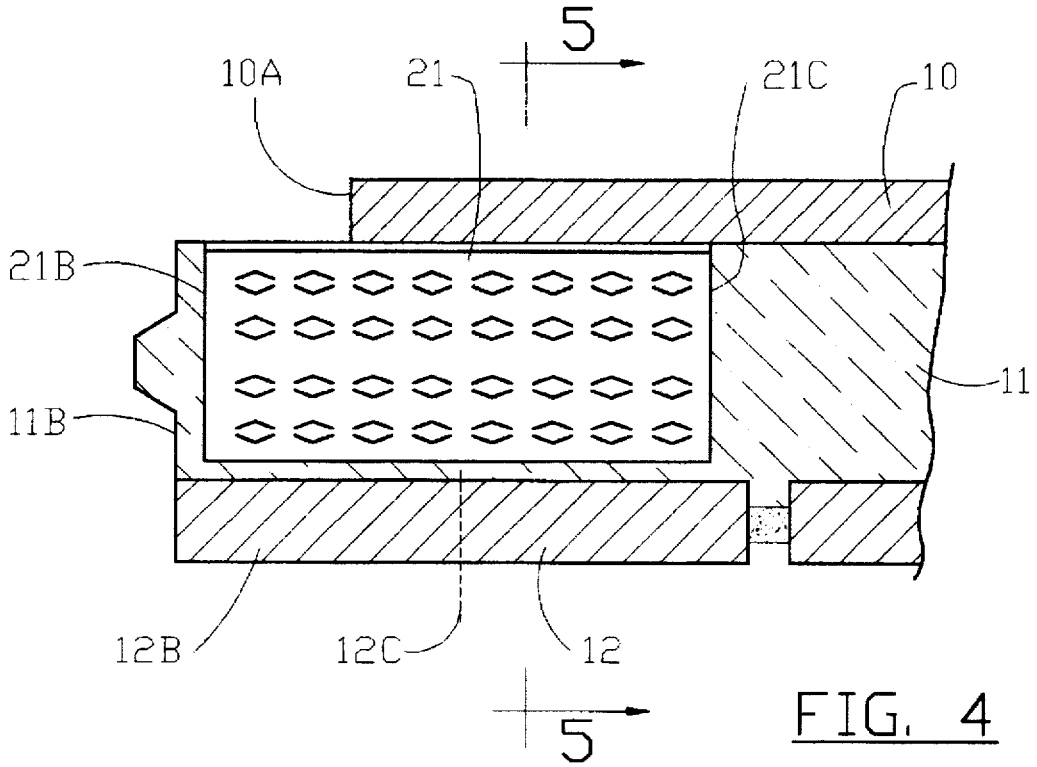
FIG. 4 is a cross sectional view along the lines 4—4 of FIG. 1 showing the reinforcement member.
Figure 5:
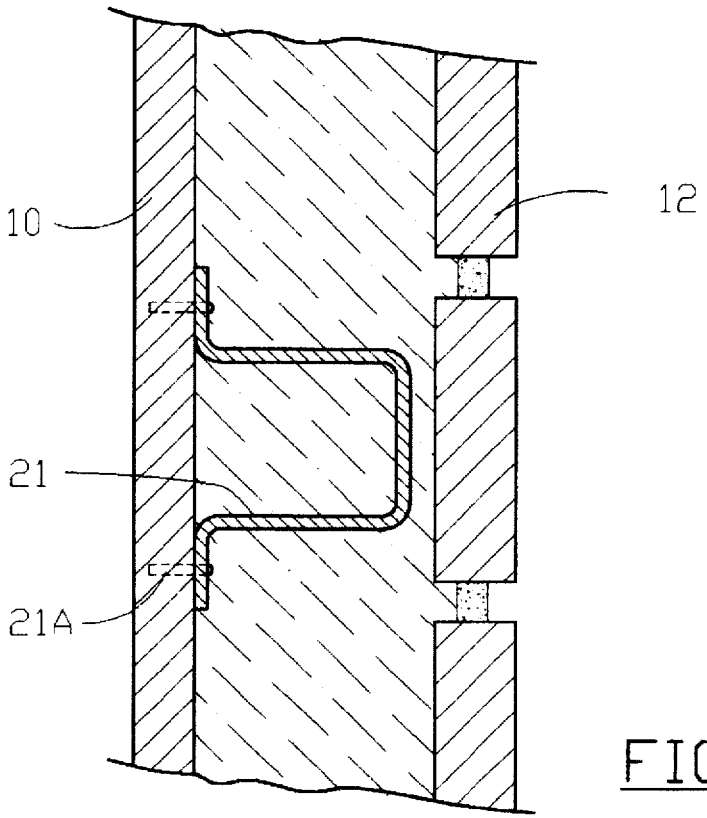
FIG. 5 is a cross sectional view along the lines 5—5 of FIG. 4.

The reinforcement elements 21 are shown in more detail in FIGS. 4 and 5. These reinforcement elements are located only adjacent those facing elements which project outwardly from the ends of the board 10. As shown in FIG. 1 it will be noted that, in order to properly interlock one panel with the next, six of the facing elements and the associated portion of the sheet 11 behind that facing element project outwardly beyond the end of the board. These elements then of course interlock with the recessed elements of the same row in the next adjacent panel.

It will be noted from FIGS. 1 and 4 that one half of the end facing element indicated at 12B commencing at a center line 12C extends outwardly beyond the end of the facing elements in the next adjacent rows. However the board 10 is located so that it has an end 10A positioned approximately halfway along the overhanging section 12B so as to provide some support for that section. The same amount of overhang is provided at the opposed end of the panel. It will of course be appreciated that, with the edges of adjacent boards abutting, it is not possible to provide the board with a greater dimension than that as shown. Therefore a portion of the end facing element and its associated portion of the sheet extends beyond the edge 10A of the board 10. This facing element and the portion of the sheet is therefore exposed and can be damaged if knocked during transportation or installation. There is therefore an ongoing problem that a significant number of the panels are damaged in this way and once damaged cannot of course be used. The reinforcing elements 21 are therefore provided. The reinforcing elements are separate and distinguished from the foamed sheet 11 itself and are embedded in the foam sheet to provide a stiffness and resistance to damage in that area of the foam sheet exposed beyond the end of the board 10A. Various arrangements of the reinforcing element are possible including stiff rods attached to the inside face of the board 10. In the embodiment shown, however, the preferred arrangement comprises a portion of expanded metal which is bent to form a channel member generally of U-shape as best shown in FIG. 5. The expanded metal has openings between the metal strips allowing the penetration of the foam during the foaming process. The expanded metal sheet is attached to the board 10 by a staple 21A or the like which holds the reinforcing element in place when the board is applied to the mold prior to the foaming process. The element must be held in place to the board to prevent its movement when the foam is injected. The sides of the U-shape extend from a base of the U-shape attached to the board up to a position closely adjacent or in engagement with the rear surface of the facing element so that the reinforcing element provides additional stiffness particularly in cooperation with the injected foam which passes through the openings in the expanded metal.

The reinforcing member has a dimension substantially equal to that of the facing element so that an outer most end 21B is located adjacent an end face 11B of the sheet. An inner end 21C of the reinforcing element is spaced inwardly of the end of the board 10A and preferably adjacent an inner end of the end facing element.

Figure 6:
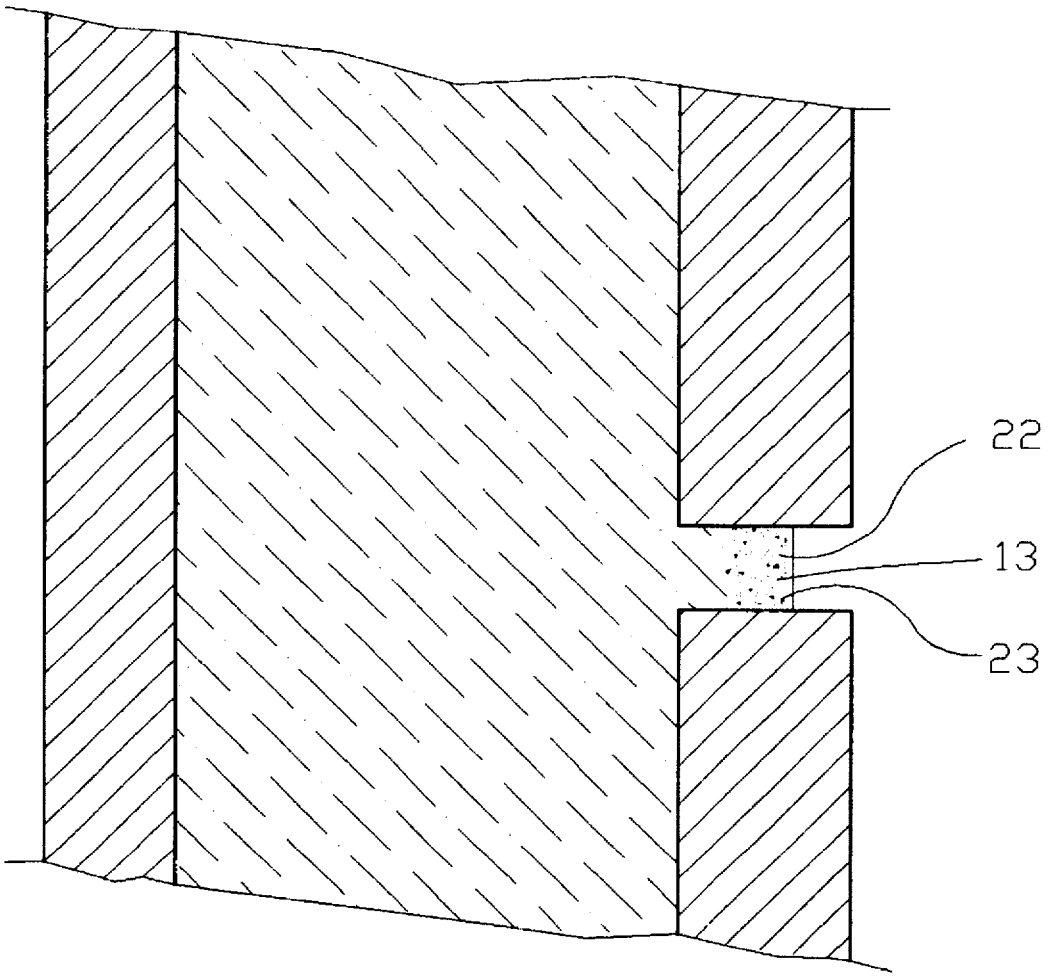
FIG. 6 is a cross sectional view through one portion of the panel on an enlarged scale showing the structure of the covering layer.

As best shown in FIG. 6, a further heat or combustion retardancy effect is provided by an additive into the aggregate forming the covering layer 13. Thus in one embodiment the aggregate is formed of an intimate mixture of the aggregate 23 with gypsum indicated at 22. In manufacture of the product, the aggregate is deposited into the spaces between the facing elements in a mold which sets out the spacing element in the required pattern. The mold also provides support elements which lift the aggregate so that it spaced away from the front face of the facing elements to simulate mortar. When the foaming occurs, the foam penetrates the aggregate and bonds intimately with the aggregate to form a monolithic structure so that the aggregate is prevented from flaking away from the foam but at the same time protects the foam and prevents the exposure of the foam directly at the front face of the aggregate.

The improvement herein provides the addition of the gypsum which tends to dissipate heat when heat from combustion is applied to the outside face of the panel since gypsum contains water molecules which are released from the molecular structure when the temperate exceeds the boiling point of water. The release of the water molecules therefore in the form of steam extracts heat and releases it from the structure thus maintaining the temperature cooler than would otherwise occur. This is particularly important in the area of the aggregate or the covering layer 13 since this is relatively thin in comparison with the facing elements. In view of the intimate bonding of the foam into the aggregate also, there is more possibility of the combustion reaching the foam and therefore it is more important in this area to ensure that the temperature is kept as low as possible.

As an alternative to the intimate mixture of the aggregate and the gypsum, it is possible to provide a gypsum as a separate layer which is applied into the structure spaced away from the outside surface of the covering layer. This effect is obtained in the manufacture of the product by applying the aggregate between the facing elements in the conventional manner and the adding a layer or dusting of the gypsum over the rear face of the facing elements and the aggregate prior to closing the mold and completing the foaming action. This generates a layer of the gypsum within the structure of the panel which can act to generate a cooling effect in the event of a fire heating the front face of the panel.

Figure 7:
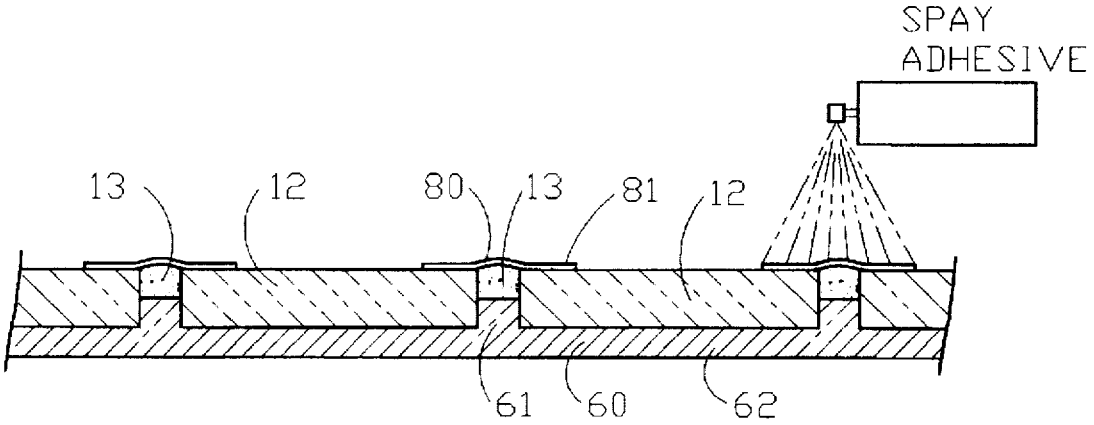
FIG. 7 is a cross-sectional view through one portion of the panel prior to the foaming process with the facing elements and the aggregate initially horizontal for filling of the aggregate into the spaces in the mold between the facing elements.
Figure 8:
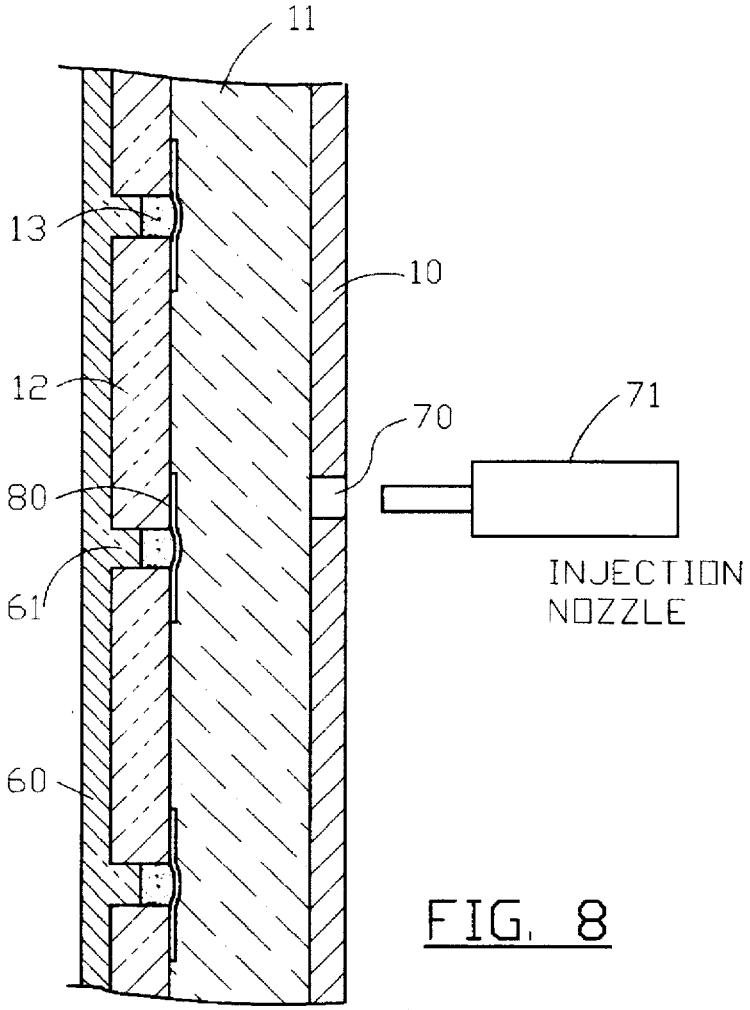
FIG. 8 is similar cross-sectional view to that of FIG. 7 in which the mold, facing elements and aggregate are tilted and the foaming process is completed.

More detail of the method of manufacture is shown in FIGS. 7 and 8 in which a mold for supporting the facing elements at 12 and the aggregate 13 is indicated at 60 and includes a generally horizontal planar backing plate 62 with a plurality of ribs 61 forming an upper surface of the backing plate at positions to locate and space the facing elements 12. The ribs 61 are raised from the horizontal upper surface of the backing plate so as to support the aggregate 13 recessed away from the front face of the facing elements which of course are arranged horizontally in the initial position shown in FIG. 7.

In operation of the method, therefore, the mold is filled with the facing elements which are laid in a grid pattern within the recesses defined by the ribs 61. The aggregate 13 is then poured into position in the spaces between the facing elements up to a depth approximating the rear or upper surface of the facing elements. Subsequent to the filling of the aggregate, the board 10 is moved into position and clamped at a predetermined spacing from the rear face of the facing elements and the foam polymer material is injected through a hole 70 in the board 10 from an injection nozzle 71. The foam then fills the space between the board and the rear face of the facing elements and monolithically integrates with the aggregate to hold the aggregate in position.

In a situation where it is necessary to tilt the base plate of the mold and the facing elements carried thereby, for example for the manufacture of corner members, the aggregate is held in place between the facing elements by an applied coating 80 of a spray adhesive. Various types of spray adhesive are currently available and supplied in an aerosol can which ejects the adhesive material in the form of a fine spray. Examples of suitable spray adhesive are manufactured by the 3M company. The coating 80 is applied over the upper particles of the aggregate with the coating extending as indicated at 81 beyond the aggregate and onto the adjacent face of the facing elements. The coating is just sufficient to bond the outer most aggregate particles together and to bond the particles to the adjacent surface of the facing elements to hold the outermost layer of aggregate particles in position within the space above the ribs 61. With the aggregate so held in place by the coating 80, the mold including the aggregate and the facing elements can be tilted to a vertical or near vertical position as shown in FIG. 8 for the injection of the foam from the injection nozzle 71. The foam in action causes the polymeric material to penetrate through the coating 80 and to engage into the aggregate to form a monolithic integral structure with the aggregate.

The coating of the spray adhesive is thus insufficient to prevent the penetration of the polymeric material during the foaming action and the polymeric material is driven through the adhesive as the injection/foaming occurs. The spray adhesive is preferably of a transparent material so that it does not color or stain the foamed polymeric material after the foaming action is complete. The spray adhesive is of a character which thus provides simply sufficient adhesive effect to hold the aggregate in place but does not in any way interfere with the conventional foaming action and the penetration of the foam into the aggregate. Furthermore the spray adhesive is of a character which allows it to set up rapidly to reduce to a minimum the delay time necessary after the spraying action is complete before the tilt into the vertical position can be effected.

The use of the spray adhesive is very rapid and inexpensive and thus allows the manufacture of corner pieces at reduced costs and with less labor content.

Since various modifications can be made in our invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A prefabricated composite building panel for attachment to a vertical wall of a building comprising a rigid sheet of cellular polymeric material having an outer face for facing outwardly of the wall and an inner face for facing inwardly of the wall, a plurality of rigid facing elements embedded in the outer face of the sheet so as to define an outermost surface of the panel, the facing elements being attached to the outer face in a pattern defining spaces between at least some of the facing elements and adjacent ones of the facing elements, a covering layer on the outer face of the sheet in the spaces and mechanical support means engaging the sheet and formed from a rigid material different from the cellular polymeric material and engaging a plurality of the facing elements to provide mechanical support of the facing elements to resist downward sagging of the facing elements on the sheet.

2. The panel according to claim 1 wherein the mechanical support means includes an upper hanger portion having a generally horizontal element for engaging a part of the sheet and for communicating downward forces from the facing elements into the sheet.

3. The panel according to claim 1 wherein the mechanical support means comprises a unitary support body having a plurality of engagement elements thereon each for engaging a respective one of the facing elements.

4. The panel according to claim 1 wherein the mechanical support means is formed of metal so as to provide resistance to combustion.

5. The panel according to claim 1 wherein the mechanical support means comprises a substantially vertical strip having a plurality of engagement elements thereon at spaced positions therealong each for engaging a respective one of the facing elements.

6. The panel according to claim 5 wherein the engagement elements are formed from portions of the strip turned outwardly from a general plane of the strip for engaging under an edge of a respective one of the facing elements.

7. The panel according to claim 1 wherein the facing elements comprise rectangular bodies arranged in rows with spaces therebetween and wherein the mechanical support means is arranged to engage facing elements in a plurality of the rows.

8. The panel according to claim 7 wherein the facing elements are engaged at a bottom edge thereof.

9. The panel according to claim 1 wherein the mechanical support means is molded into the sheet by injection of a foaming material around the mechanical support means.

10. The panel according to claim 7 wherein the mechanical support means comprises a plurality of vertical elongate members at spaced positions horizontally of the panel with each member having elements thereon each for engaging a respective one of the facing elements intersected by the vertical member.

11. The panel according to claim 1 wherein the mechanical support means comprises a plurality of vertical elongate strip members at spaced positions horizontally of the panel, each having a plurality of engagement elements thereon at spaced positions therealong for engaging a respective one of the facing elements and each including an upper hanger portion having a generally horizontal element for engaging a part of the sheet and for communicating downward forces from the facing elements into the sheet, wherein the facing elements comprise rectangular bodies arranged in rows with spaces therebetween and wherein the mechanical support means is arranged to engage facing elements in a plurality of the rows and wherein the mechanical support means is molded into the sheet by injection of a foaming material around the mechanical support means.

12. The panel according to claim 1 wherein the covering layer is formed from an aggregate monolithically foamed into the outer face, the aggregate including a weather resistant particulate material and gypsum.

13. The panel according to claim 12 wherein the gypsum and the aggregate are intimately blended.

14. The panel according to claim 1 wherein the facing elements comprise rectangular bodies arranged in rows with spaces therebetween, the pattern being arranged such that at each end of the panel there are a plurality of the facing elements each of which has a portion thereof projecting from and exposed at the end of the sheet, each of said elements having a portion of the sheet behind the element, and reinforcement means formed from a material different from the cellular polymeric material and embedded within the sheet and extending into the portion of the sheet behind the element.

15. The panel according to claim 14 wherein the reinforcement means is formed from expanded metal.

16. The panel according to claim 14 wherein the reinforcement means is formed into substantially a channel shape.

17. The panel according to claim 14 wherein the panel includes a rigid support board bonded onto the inner face of the sheet and extending over a majority of the sheet leaving the projecting elements exposed beyond one end of the board.

18. The panel according to claim 17 wherein the reinforcement means is attached to the board.

19. A prefabricated composite building panel for attachment to a vertical wall of a building comprising a rigid sheet of cellular polymeric material having an outer face for facing outwardly of the wall and an inner face for facing inwardly of the wall, a plurality of rigid facing elements embedded in the outer face of the sheet so as to define an outermost surface of the panel, the facing elements being attached to the outer face in a pattern defining spaces between at least some of the facing elements and adjacent ones of the facing elements, and a covering layer on the outer face of the sheet in the spaces wherein the covering layer is formed from an aggregate monolithically foamed into the outer face, the aggregate including a weather resistant particulate material and a heat dissipating material comprising gypsum.

20. The panel according to claim 19 wherein the gypsum and the aggregate are intimately blended.

21. A prefabricated composite building panel for attachment to a vertical wall of a building comprising a rigid sheet of cellular polymeric material having an outer face for facing outwardly of the wall and an inner face for facing inwardly of the wall, a plurality of rigid facing elements embedded in the outer face of the sheet so as to define an outermost surface of the panel, the facing elements being attached to the outer face in a pattern defining spaces between at least some of the facing elements and adjacent ones of the facing elements, a covering layer on the outer face of the sheet in the spaces, the facing elements comprising rectangular bodies arranged in a staggered pattern with spaces therebetween, the pattern being arranged such that at each end of the panel there are a plurality of the facing elements each of which has a portion thereof projecting from and exposed at the end of the sheet, each of said elements having a portion of the sheet behind the element, and reinforcement means formed from a material different from the cellular polymeric material and embedded within the sheet and extending into the portion of the sheet behind the element.

22. The panel according to claim 21 wherein the reinforcement means is formed from expanded metal.

23. The panel according to claim 21 wherein the reinforcement means is formed into substantially a channel shape.

24. The panel according to claim 21 wherein the panel includes a rigid support board bonded onto the inner face of the sheet and extending over a majority of the sheet leaving the projecting elements exposed beyond one end of the board.

25. A prefabricated composite building panel for attachment to a vertical wall of a building comprising a rigid sheet of cellular polymeric material formed by a foaming process and having an outer face for facing outwardly of the wall and an inner face for facing inwardly of the wall, a plurality of rigid facing elements embedded in the outer face of the sheet during the foaming process so as to define an outermost surface of the panel, the facing elements being attached to the outer face in a pattern defining spaces between at least some of the facing elements and adjacent ones of the facing elements, a coveting layer on the outer face of the sheet in the spaces, the coveting layer being formed from an aggregate monolithically integrated into the outer face of the sheet, a coating of a spray adhesive disposed over particles of the aggregate and onto the adjacent ones of the facing elements, wherein the sheet is integrated with the coating and the aggregate to form a monolithic integral structure.

26. The panel according to claim 25 wherein the coating engages those particles of the aggregate which are exposed between the facing elements prior to the foaming process and the facing elements adjacent the aggregate to hold the aggregate in position between the facing elements.

* * * * *